United States Patent [19]

Quist et al.

[11] 4,336,075

[45] Jun. 22, 1982

[54] ALUMINUM ALLOY PRODUCTS AND METHOD OF MAKING SAME

[75] Inventors: William E. Quist, Redmond; Michael V. Hyatt; Sven E. Axter, both of Bellevue, all of Wash.

[73] Assignee: The Boeing Company, Seattle, Wash.

[21] Appl. No.: 108,214

[22] Filed: Dec. 28, 1979

[51] Int. Cl.[3] ..... C22F 1/04

[52] U.S. Cl. ..... 148/2; 148/11.5 A; 148/12.7 A; 148/417; 148/439

[58] Field of Search ..... 148/2, 3, 12.7 A, 32, 148/32.5, 11.5 A; 75/141, 142

[56] References Cited

U.S. PATENT DOCUMENTS 3,826,688 7/1974 Levy ..... 148/32.5

*Primary Examiner*—R. Dean

*Attorney, Agent, or Firm*—Christensen, O'Connor, Johnson & Kindness

[57] ABSTRACT

A 2000 series aluminum alloy characterized by high strength, high fatigue resistance, and high fracture toughness consists essentially of 4.2 to 4.7 percent copper, 1.3 to 1.8 percent magnesium, 0.8 to 1.3 percent manganese, 0.08 to 0.15 percent zirconium, maximums of 0.15 percent iron, 0.12 percent silicon, 0.25 percent zinc, 0.15 percent titanium, 0.10 percent chromium, 0.05 percent of each of any other trace elements present, and a maximum total of such other trace elements of 0.15 percent, the balance of the alloy being aluminum. The foregoing alloy is hot-worked and heat-treated to yield a final wrought product having a highly elongated and substantially unrecrystallized microstructure.

22 Claims, 12 Drawing Figures

ALLOY FE-100X

ALLOY JA-100X

ALUMINUM ALLOY PRODUCTS AND METHOD OF MAKING SAME

BACKGROUND OF THE INVENTION

The present invention relates to aluminum alloys, and more particularly to a 2000 series alloy of the aluminum-copper-magnesium type characterized by high strength, very high fatigue resistance, and high fracture toughness.

A significant economic factor in operating aircraft today is the cost of fuel. As a consequence, aircraft designers and manufacturers are constantly striving to improve overall fuel efficiency. One way to increase fuel efficiency, as well as overall airplane performance, is to reduce the structural weight of the airplane. Since aluminum alloys are used in a large number of structural components of most aircraft, significant efforts have been expended to develop aluminum alloys that have higher strength-to-density ratios than the alloys in current use, while maintaining the same or higher fracture toughness, fatigue resistance, and corrosion resistance.

For example, one alloy currently used on the lower wing skins of some commercial jet aircraft is alloy 2024 in the T351 temper. Alloy 2024-T351 has a relatively high strength-to-density ratio and exhibits good fracture toughness, good fatigue properties, and adequate corrosion resistance. Another currently available alloy sometimes used on commercial jet aircraft for similar applications is alloy 7075-T651. Alloy 7075-T651 is stronger than alloy 2024-T351; however, alloy 7075-T651 is inferior to alloy 2024-T351 in fracture toughness and fatigue resistance. Thus, the higher strength-to-density ratio of alloy 7075-T651 often cannot be used advantageously without sacrificing fracture toughness and/or fatigue performance of the component on which it is desired to use the alloy. Likewise, other currently available alloys in their various tempers; for example, alloys 7475-T651, -T7651, and -T7351; 7050-T7651 and -T73651; and 2024-T851; although sometimes exhibiting good strength or fracture toughness properties and/or high resistance to stress-corrosion cracking and exfoliation corrosion, do not offer the combination of improved strength, improved fracture toughness, and improved fatigue properties over alloy 2024-T351. Thus, with currently available alloys in various tempers, it is usually impossible to achieve weight savings in aircraft structural components presently fabricated from alloy 2024-T351 if fracture toughness, fatigue resistance, and corrosion resistance must be maintained at or above the current levels.

It is therefore an object of the present invention to provide an aluminum alloy for use in structural components of aircraft that has a higher strength-to-density ratio than the currently available alloy 2024-T351, and additionally which has improved fatigue and fracture toughness characteristics over alloy 2024-T351. It is further object of the present invention to maintain stress-corrosion resistance and exfoliation-corrosion resistance at a level approximately equivalent to or better than that of alloy 2024-T351.

SUMMARY OF THE INVENTION

The 2000 series alloy of the present invention fulfills the foregoing objectives by providing a strength increase of about 8% over alloy 2024 in T3 tempers. Indeed, the alloy of the present invention is stronger than any other commercially available 2000 series aluminum alloy in the naturally aged condition. At the same time, fracture toughness and fatigue resistance of the aluminum alloy of the present invention are higher than that achieved in aluminum alloys having strengths equal to or approaching that of the alloy of the present invention, such as alloy 2024 in the T3, T4, or T8 tempers. In particular, the fatigue resistance of the alloy of the present invention is superior to that exhibited by any other aluminum alloy in commercial use. Additionally, the corrosion resistance of the alloy of the present invention is approximately equal to that exhibited by alloy 2024 in the T3 or T4 tempers.

The desired combination of properties of the 2000 series aluminum alloy of the present invention is achieved by properly controlling the chemical composition ranges of the alloying elements and impurity elements, by increasing the manganese content over that present in conventional 2024-type alloys, by the addition of zirconium, by maintaining a highly elongated, substantially unrecrystallized microstructure, and by a longer than normal period of natural age hardening. The alloy of the present invention consists essentially of 4.2 to 4.7% copper, 1.3 to 1.8% magnesium, 0.8 to 1.3% manganese, and 0.08 to 0.15% zirconium, the balance of the alloy being aluminum and trace elements. Of the trace and impurity elements present, the maximum allowable amount of zinc is 0.25%, of titanium is 0.15%, of chromium is 0.10%, of iron is 0.15%, and of silicon is 0.12%. For any other trace elements present in the alloy, the maximum allowable amount of any one such element is 0.05% and the total allowable amount of the other trace elements is 0.15%. Once the alloy is cast, it is homogenized and then hot-worked to provide a wrought product, such as extrusions or plate. The product is then solution treated, quenched, stretched, and thereafter naturally aged at room temperature to the maximum strength condition.

The high strength of the invention alloy is achieved by the combination of the alloying elements copper, magnesium, and manganese, by homogenizing at a moderate temperature, by carefully controlling the hot-rolling and extrusion parameters to produce a highly elongated, substantially unrecrystallized microstructure in the final product, and by an extended period of natural age-hardening. The fracture toughness of the alloy of the present invention is maintained at a high level by closely controlling the chemical composition within the ranges set forth above and also by the aforementioned process controls. The very high fatigue resistance of the alloy of the present invention is achieved by the closely controlled composition, by the aforementioned process controls, by an unrecrystallized grain structure, and, in particular, by the addition of zirconium.

BRIEF DESCRIPTION OF THE DRAWINGS

A better understanding of the present invention can be derived by reading the ensuing specification in conjunction with the accompanying drawings, wherein.

DETAILED DESCRIPTION OF THE INVENTION

The high strength, high fatigue resistance, high fracture toughness, and corrosion resistance properties of the alloy of the present invention are dependent upon a chemical composition that is closely controlled within specific limits as set forth below, upon a carefully controlled heat treatment, upon a highly elongated and substantially unrecrystallized microstructure, and upon a longer than normal period of natural age-hardening. If the composition limits, fabrication, and heat-treatment procedures required to produce the invention alloy stray from the limits set forth below, the desired combination of strength increase, fracture toughness increase, and fatigue improvement objectives will not be achieved.

The aluminum alloy of the present invention consists essentially of 4.2 to 4.7% copper, 1.3 to 1.8% magnesium, 0.8 to 1.30% manganese, and 0.08 to 0.15% zirconium, the balance being aluminum and trace and impurity elements. For the trace and impurity elements zinc, titanium, and chromium present in the invention alloy, the maximum allowable amount of zinc is 0.25% of titanium is 0.15%, and of chromium is 0.10%. For the impurity elements iron and silicon, the maximum allowable amount of iron is 0.15% and of silicon is 0.12%. For any other remaining trace elements, each has a maximum limit of 0.05%, with a maximum total for the remaining trace elements being 0.15%. The foregoing percentages are weight percentages based upon the total alloy.

Figure 1:
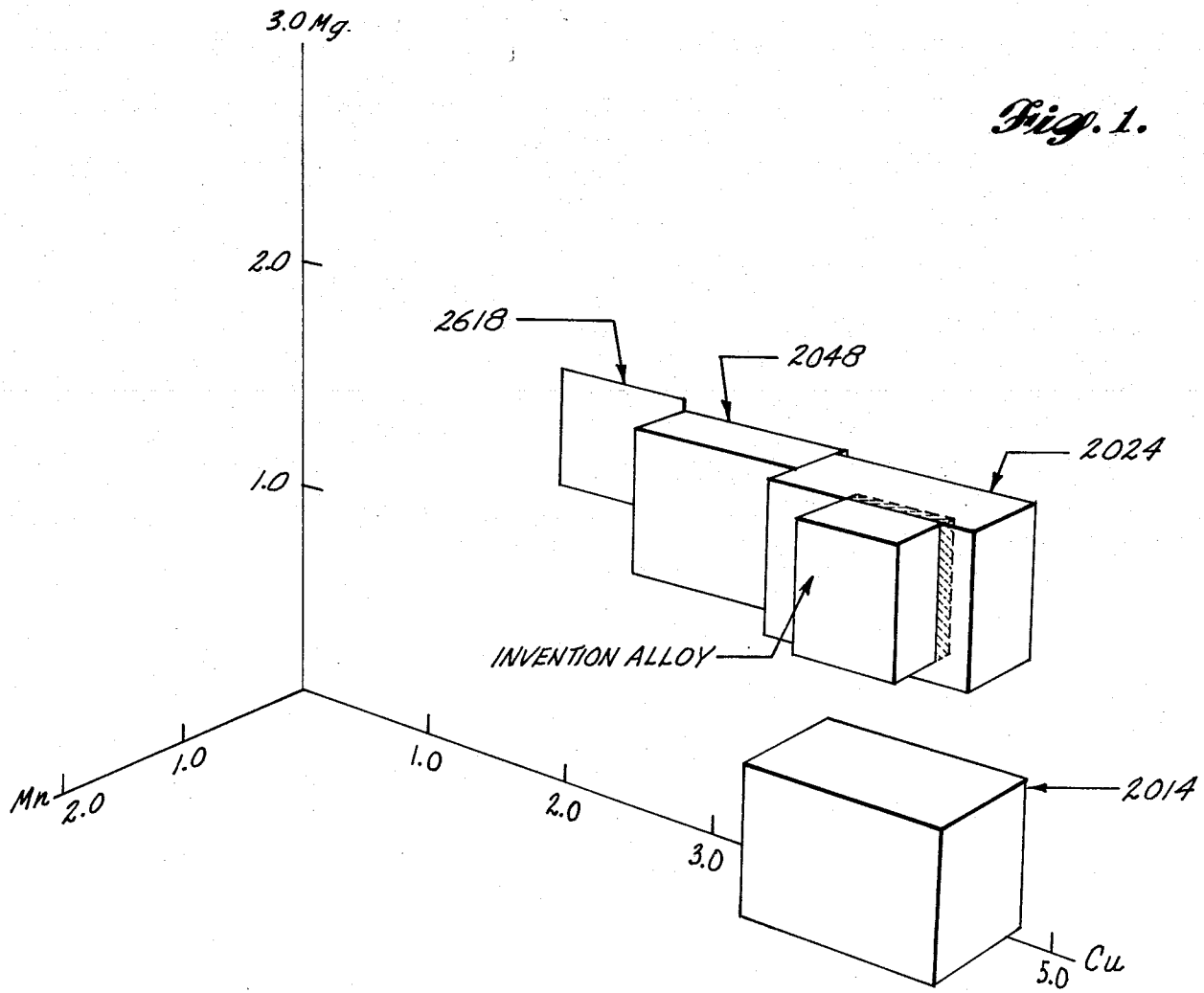
FIG. 1 is a graph of chemical composition limits of copper, magnesium, and manganese in the invention alloy compared with other 2000 series aluminum alloys.

The chemical composition of the alloy of the present invention is similar to that of alloy 2024, but is distinctive in several important aspects. FIG. 1 shows the compositional limits of the invention alloy with respect to several common prior art 2000 series alloys used in the aircraft and other industries, including alloys 2014, 2024, 2048, and 2618. One will not that the allowed range of variation for alloying elements contained in the invention alloy is less than for the other alloys shown, an important consideration in the present invention because many mechanical and physical properties change as composition changes. Therefore, to maintain the desired close balance of properties in the invention alloy, it is necessary to restrict composition changes to a greater degree than is normally done. In addition to the restricted ranges of copper, magnesium, and manganese, as shown in FIG. 2, the iron and silicon contents are reduced to the lowest levels commercially feasible for aluminum alloys of the present type in order to improve the fracture toughness characteristics.

Specifically, the items of prime importance to the chemical constitution of the invention alloy will now be discussed. Excessive copper reduces fracture toughness through the formation of large intermetallic particles, such as $CuAl_2$, and $Al_2CuMg$, whereas insufficient copper results in a strength decrease by reducing the amount of copper available to participate in the precipitation-hardening reactions. Excessive magnesium reduces fracture toughness through the formation of large intermetallic particles such as $Al_2CuMg$. In addition, excessive amounts of copper and magnesium bring about the deterioration of fatigue crack growth resistance at relatively high stress intensities. On the other hand, insufficient magnesium results in a reduction in strength by reducing the amount of magnesium free to participate in precipitation-hardening reactions (primarily the formation of small and finely dispersed $Al_2CuMg$ phase).

Figure 2B:
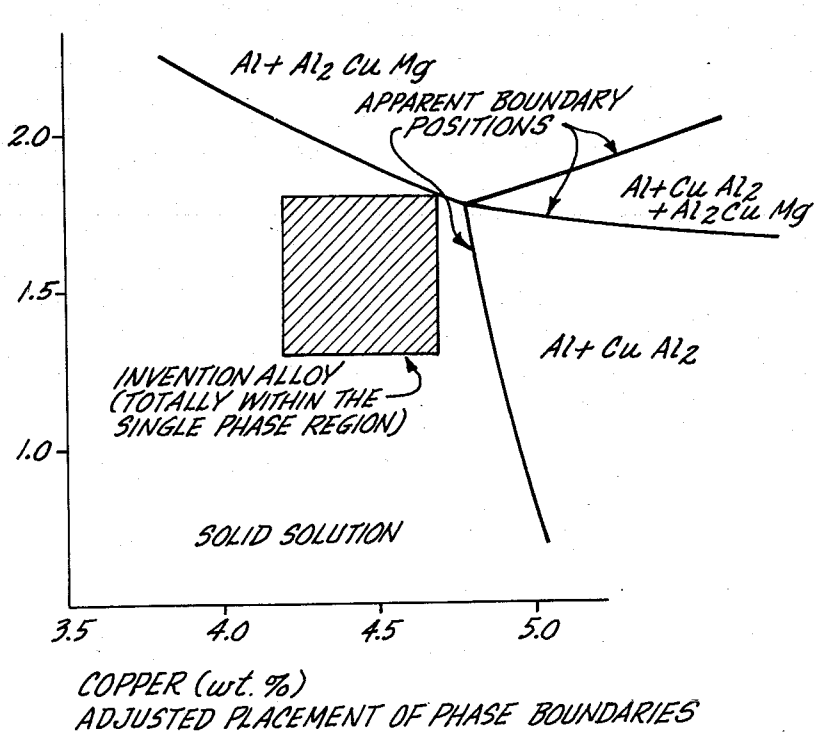
FIGS. 2*a* and 2*b* are graphs showing the phase boundaries in the Al-Cu-Mg system at a temperature approximating the solution treatment temperature and an approximation of their actual boundary locations in the invention alloy as influenced by its nominal iron, silicon, and manganese content.
Figure 2A:
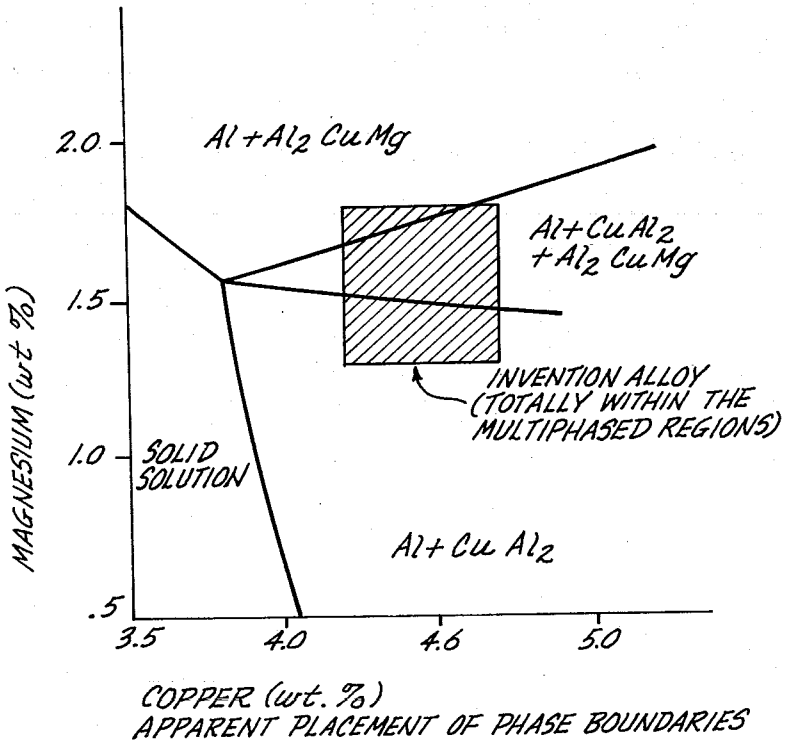

An important feature in the chemical constitution of the alloy of the present invention is graphically illustrated by reference to FIGS. 2*a* and 2*b*. FIG. 2*a* shows a portion of the Al-Mg-Cu phase diagram at a temperature approximating the solution treatment temperature for the subject alloy. A general objective of the chemical formulation of the alloy of the present invention has been to maximize the amount of solute in solid solution during solution treatment (to maximize subsequent solution hardening effects), yet not intrude into the two or three phase regions. Intrusion into these regions would result in large, brittle $CuAl_2$ and $Al_2CuMg$ intermetallic particles being retained throughout the microstructure following the solution treatment and quench, which would cause a reduction in fracture toughness. With this in mind, it would at first seem that the composition of the invention alloy was excessive in the amounts of magnesium and copper specified. However, consideration of the removal of copper and magnesium from solid solution by the intermetallic compounds formed during solidification, homogenizing, and hot rolling, and consideration of the amount of these particles retained through the solution treatment, will reveal that a very different situation actually prevails. FIG. 2*b* shows the "effective" position of the phase boundaries at 935° F. assuming a nominal composition of 0.1% Fe, 0.1% Si, and 1.0% Mn, and assuming that these elements have completely reacted to form the undesirable intermetallic constituents $Al_7Cu_2Fe$ and $Mg_2Si$, and the desirable dispersoids $Al_{20}Cu_2Mn_3$. Thus, under ideal circumstances, the matrix composition of copper and magnesium in the alloy of the present invention is maximized for strength and resides completely within the single phase region, as desired, with the minimum possible volume fraction of $Al_7Cu_2Fe$ and $Mg_2Si$. While the idealized compound formation does not take place completely, a close approximation of the condition depicted in FIG. 2*b* does in fact exist, thereby dictating the desired formulation of alloying elements as set forth above for strength, fracture toughness, and fatigue property considerations.

In the alloy of the present invention, manganese contributes to the strengthening through the formation of small $Al_{20}Cu_2Mn_3$ dispersoid particles. These particles have some dispersion strengthening effect due to the inhibiting of dislocation movement, but they also are effective in reducing grain size and contribute to an elongated and textured unrecrystallized grain structure. This improved strength properties in the direction of rolling, the direction of prime importance for plate and extrusion applications in the aircraft industry.

Increasing the amount of manganese content in commercially available 2024-type alloys, would result in decreasing the fracture toughness as well as lowering the fatigue properties. No reduction in toughness properties is experienced with the invention alloy, however, because the iron and silica levels are maintained at a low level and because an unrecrystallized structure is maintained in the alloy. An elongated, unrecrystallized structure presents an extremely long, tortuous path for a would be intergranular crack, thereby forcing fracture to occur through (i.e., transgranular) and not around grains, and thus increases fracture resistance. The high manganese content in the invention alloy tends to inhibit recrystallization. The effectiveness of manganese in inhibiting recrystallization is enhanced by utilizing a lower than normal ingot homogenizing temperature (about 880° F.) so that a finer and denser dispersion of $Al_{20}Cu_2Mn_3$ particles is developed, raising the recrystallization temperature and restricting grain growth. When care is taken during processing of the alloy to avoid recrystallization, the resulting wrought product has a higher fracture toughness in the longitudinal or rolling direction, on the average, than commercially available 2024-T3 alloys.

The reaction is fatigue properties that a high manganese content causes in alloys of the 2024-T3 type is compensated for by addition of zirconium to the invention alloy. It has been discovered that the addition of 0.08% to 0.15% zirconium, in conjunction with the microstructure brought about by the other composition and hot-working controls, enhances the fatigue properties of the invention alloy. The zirconium addition causes an unusual and distinct change in the fracture topography along a fatigue crack. In conventional 2024-T3 or -T4 type alloys, the fracture surface is relatively smooth on a macro scale; and the local crack growth direction is generally perpendicular to the applied load. To the contrary, the fracture surface of the invention alloy is quite rough, exhibiting a sawtooth or angular fracture surface topography. This topography is due to considerable local crack growth cut out of the macroscopic crack plane. The local deviation of the crack front from the crack plane is thought to be partially responsible for the overall reduction in the rate of crack growth. The fatigue crack growth rate at high stress intensities is also reduced by maintaining a microstructure that is free of most large intermetallic compounds.

The volume of fraction of large intermetallic particles in 2024 and similar type alloys is often upwards of 2.5%, whereas the volume fraction present in the invention alloy is lower, on the order of 1%.

Iron and silicon contents are restricted in the alloy of the present invention in order to reduce the amount of large intermetallic particles (primarily $Al_7Cu_2Fe$ and $Mg_2Si$) that will be present, and thereby improve fracture toughness and also fatigue crack growth resistance in the high growth rate regime.

If the total volume fraction of large intermetallic compounds formed by copper, magnesium, iron, and silicon, such as $CuAl_2$, $CuMgAl_2$, $Al_7Cu_2Fe$, and $Mg_2Si$, is less than about 1.5 volume percent in the alloy of the present invention, the fracture toughness of the unrecrystallized product will achieve the desired levels. The fracture toughness properties of the alloy of the present invention will be enhanced even further if the total volume fraction of such intermetallic compounds is within the range of about 0.5 to about 1.0 volume percent of the total alloy. If the foregoing preferred range of intermetallic particles is maintained in a highly elongated or substantially unrecrystallized structure, the fracture toughness of the invention alloy will substantially exceed that of prior art alloys of similar strength.

One unusual and unexpected phenomenon occurs during the natural aging of the alloy of the present invention. The strength during natural aging continues to increase for times beyond 180 days. This is contrary to normal 2024-type aluminum alloys containing copper and magnesium, where natural age-hardening is essentially complete in approximately 4 days. For the alloy of the present invention, the increase in strength is about 2 ksi for the interval between 4 and 180 days. This continued aging is one of the factors contributing to the strength advantage of the alloy of the present invention over alloys such as the 2024-type.

It has been determined that this additional aging response is dependent upon the chemical composition and the amount of stretcher straightening given the alloy following quenching. The effect of chemical composition is not completely clear, but it is believed that the increased manganese present in this alloy (1.05% nominal compared to 2024, which contains 0.5% nominal manganese) is the principal cause of the continued hardening response. Little strengthening takes place beyond 4 days in material that has not been stretched following quenching, but strength increases are apparent and become progressively greater for material that has been stretched 2%, 4%, and 6%. For material that has been stretched 2% to 4%, a strength increase of approximately 2 ksi occurs between 4 and 180 days.

Conventional melting and casting procedures are employed to formulate the invention alloy. Care must be taken to maintain high purity in the aluminum and the alloying constituents so that the trace and impurity elements, especially iron and silicon, are at or below the requisite maximums. Ingots are produced from the alloy using conventional procedures such as continuous direct chill casting. Once the ingot is formed, it can be homogenized by conventional techniques, but at somewhat lower temperatures than are often utilized. For example, by subjecting the ingot to an elevated temperature of about 880° F. for a period of 7 to 15 hours, one will homogenize the internal structure of the ingot and provide an essentially uniform distribution of alloying elements. This treatment also ensures a uniform dispersion of fine $Al_{20}Cu_2Mn_3$ rod shaped dispersoids, which are on the order of 0.05 to 0.1 microns in length and which aid in maintaining an unrecrystallized structure during subsequent processing. The ingot can be processed at temperatures higher than 880° F., for example as high as 920° F.; however, the higher homogenization temperatures will cause some of the grain refining elements to agglomerate, which in turn increases the risk that the alloy microstructure will be recrystallized during subsequent processing steps.

The ingot can then be subjected to conventional hot-working procedures to yield a final product such as plate or extrusions. Special care must be taken during the hot-working procedures to maintain a highly elongated, substantially unrecrystallized microstructure that will persist through the final heat treatment. By "highly elongated" it is meant that the length-to-thickness ratio of the elongated platelet-like grains exceeds at least about 10:1. Preferably, the length-to-thickness ratio is much greater, for example on the order of 100:1. By "substantially unrecrystallized" it is meant that less than about 20 volume percent of the alloy microstructure in a given product is in a recrystallized form, excepting surface layers of extrusions, in particular, that often show substantial amounts of recrystallization. These surface layers are usually removed during fabrication into final part configurations.

To help maintain the strength and toughness of extruded products at the desired improved levels, the extrusion procedure itself is controlled to minimize recrystallized in the final product. Recrystallization in the alloy is minimized by extruding somewhat hotter and slower than prior art alloys are normally extruded, to allow a partial anneal to take place during the extrusion process, thereby removing any regions of very high strain that otherwise would lead to recrystallization during the working operation itself or during the final heat treatment. The desired properties can be achieved in the alloy of the present invention when it is extruded at temperatures at or above about 750° F. while controlling the extrusion speed such that surface hot tearing is avoided and the degree of recrystallization in the final wrought product is minimized. Exact extrusion speeds and temperatures are, of course, dependent upon such factors as starting billet size, extrusion ratios, extrusion size and shape, number of die openings, and method of extrusion (direct or indirect). The uncrystallized structure is very beneficial to strength. For example, an 8 to 12 ksi or greater strength differential is commonly noted between unrecrystallized and recrystallized structures of extrusions of the invention alloy type. Likewise, the unrecrystallized structure is usually superior to its recrystallized counterpart in fatigue resistance when loaded in the longitudinal grain direction, since it is more difficult to nucleate and grow fatigue cracks normal to the elongated unrecrystallized structure.

For plate products, the highly elongated and substantially unrecrystallized structure desired in the final heat-treated product can also be achieved by rolling at somewhat hotter temperatures than used for prior art alloys; for example, by initially hot-rolling at metal temperatures in the range of from 820° F. to 880° F., preferably about 850° F., and thereafter not allowing metal temperatures to fall below about 600° F. to 650° F. To maintain the metal temperatures in the desired range during hot rolling, the plate can be reheated to temperatures in the range of 700° F. to 800° F. between successive hot rolling steps. The elongated and unrecrystallized microstructure can alternatively be maintained by the application of a partial annealing treatment applied immediately after the metal is hot rolled. The metal can be annealed by exposure at temperatures of about 700° F. to 800° F. for between 2 and 20 hours dependent upon the plate thickness and exact annealing temperature. Such annealing treatments effectively remove regions of high strain energy that develop during hot-rolling and lead to recrystallization during the final solution heat treatment. For plate thicknesses on the order of one inch or less, it is usually necessary to use the partial anneal treatment in order to maintain the elongated substantially unrecrystallized structure in the final product. It is, however, preferable to avoid such partial annealing treatments when possible because of the long holding times that are often reqired to render the treatment effective. The highly elongated and substantially unrecrystallized structure achieved by following the foregoing hot working techniques to produce the plate product is very beneficial to strength and fracture toughness properties of the alloy.

After the alloy is hot-worked into a product, the product is typically solution heat treated at a temperature up to 920° F., preferably in the range of from 900° F. to 920° F., for a time sufficient for solution effects to approach equilibrium, usually on the order of ½ to 3 hours, but possibly as long as 24 hours. Once the solution effects have approached equilibrium, the product is quenched using conventional procedures, normally by spraying the product with or immersing the product in room-temperature water.

Both plate and extruded products are stretcher stress relieved and naturally aged as the final processing step. The stretching is performed to remove residual quenching stresses from the product and to provide an additional increment of strength during natural aging. The recommended stretch is between 2% and 4% of the original length for both plate and extrusion products, which is similar to the stretch required for all commercial alloys.

Aging of the alloy is normally carried out at room temperature after stretching (that is a T3-type heat treatment), although artificial aging at elevated temperatures also can be employed if desired.

EXAMPLES

To illustrate the benefits of the invention alloy and the importance of composition and microstructure control, the following examples are presented:

EXAMPLE I

Ingots of the alloy of the present invention were formulated in accordance with conventional procedures. These ingots had a nominal composition of 4.3% copper, 1.5% magnesium, 0.9% manganese, 0.08% zirconium, 0.11% iron, 0.07% silicon, 0.01% chromium, 0.01% titanium, 0.04% zinc, and a total of about 0.03% of other trace elements, the balance of the alloy being aluminum. The ingots were rectangular in shape and had a nominal thickness of 16 inches. The ingots were scalped, homogenized at about 900° F. and hot rolled to plate thickness of 0.90 and 1.5 inches. These plates were solution treated at about 920° F. for 1 to 2 hours, depending upon thickness, and spray quenched with room-temperature water. The plates were then stretched about 2% in the rolling direction to minimize residual quenching stresses and naturally aged at room temperature for about 180 days. Microstructural examination of both thicknesses of plate confirmed that the structure was unrecrystallized. Ultimate tensile strength, fracture toughness, and fatigue crack growth rate tests were then performed on specimens taken from the plate products. The data from these tests were analyzed to provide characteristic properties for the alloy of the present invention.

Similar data from conventional, commercially available 2024-T351, 2024-T851, 7075-T651, and 7475-T651 alloy plates were also analyzed for comparison. The 2024 alloy had a nominal composition of 4.35% copper, 1.5% magnesium, 0.6% manganese, 0.26% iron, and 0.15% silicon, the balance of the alloy being aluminum and small amounts of other extraneous elements. The 7075 alloy had a nominal composition of 5.6% zinc, 2.5% magnesium, 1.6% copper, 0.2% chromium, 0.05% manganese, 0.2% iron, and 0.15% silicon, the balance of the alloy being aluminum and small amounts of other extraneous elements. The 7475 alloy had a nominal composition of 5.7% zinc, 2.25% magnesium, 1.55% copper, 0.20% chromium, 0.08% iron, 0.06% silicon, and 0.02% titanium, the balance of the alloy being aluminum and small amounts of other extraneous elements.

Ultimate tensile strength tests were performed in a conventional manner. Test data are for plate thicknesses from 0.75 to 1.5 inches.

The fracture toughness tests were also performed in a conventional manner at room temperature using center-cracked panels, with the data being represented in terms of the apparent critical stress-intensity factor ($K_{app}$) at panel fracture. The stress-intensity factor ($K_{app}$) is related to the stress required to fracture a flat panel containing a crack oriented normal to the stressing direction and is determined from the following formula:

$$K_{app}=\rho_g\sqrt{\pi a_o}\,\alpha$$

where $\rho_g$ is the gross stress required to fracture the panel, $a_o$ is one-half the initial crack length for a center-cracked panel, and $\alpha$ is a finite width correction factor (for the panels tested, $\alpha$ was slightly greater than 1). For the present tests, 48-inch-wide panels containing center cracks approximately one-third the panel width were used to obtain the $K_{app}$ values.

The data for the fatigue crack growth rate comparisons were taken from data developed from precracked single-edge-notched specimens. The panels were cyclically stressed in laboratory air at 120 cycles per minute (2 Hz) in a direction normal to the orientation of the fatigue crack and parallel to the rolling direction. The minimum to maximum stress ratio (R) for these tests was 0.06. Fatigue crack growth rates (da/dN) were determined as a function of the cyclic stress-intensity parameter ($\Delta K$) applied to the precracked specimens. The parameter $\Delta K$ (ksi $\sqrt{\text{in.}}$) is a function of the cyclic fatigue stress ($\Delta\rho$) applied to the panel, the stress ratio (R), the crack length, and the panel dimensions. Fatigue comparisons were made by noting the cyclic stress intensity ($\Delta K$) required to propagate the fatigue crack at a rate of 3.0 microinches/cycle for each of the alloys. For these tests, a higher stress-intensity factor indicates an improved resistance to fatigue crack growth.

Figure 3:
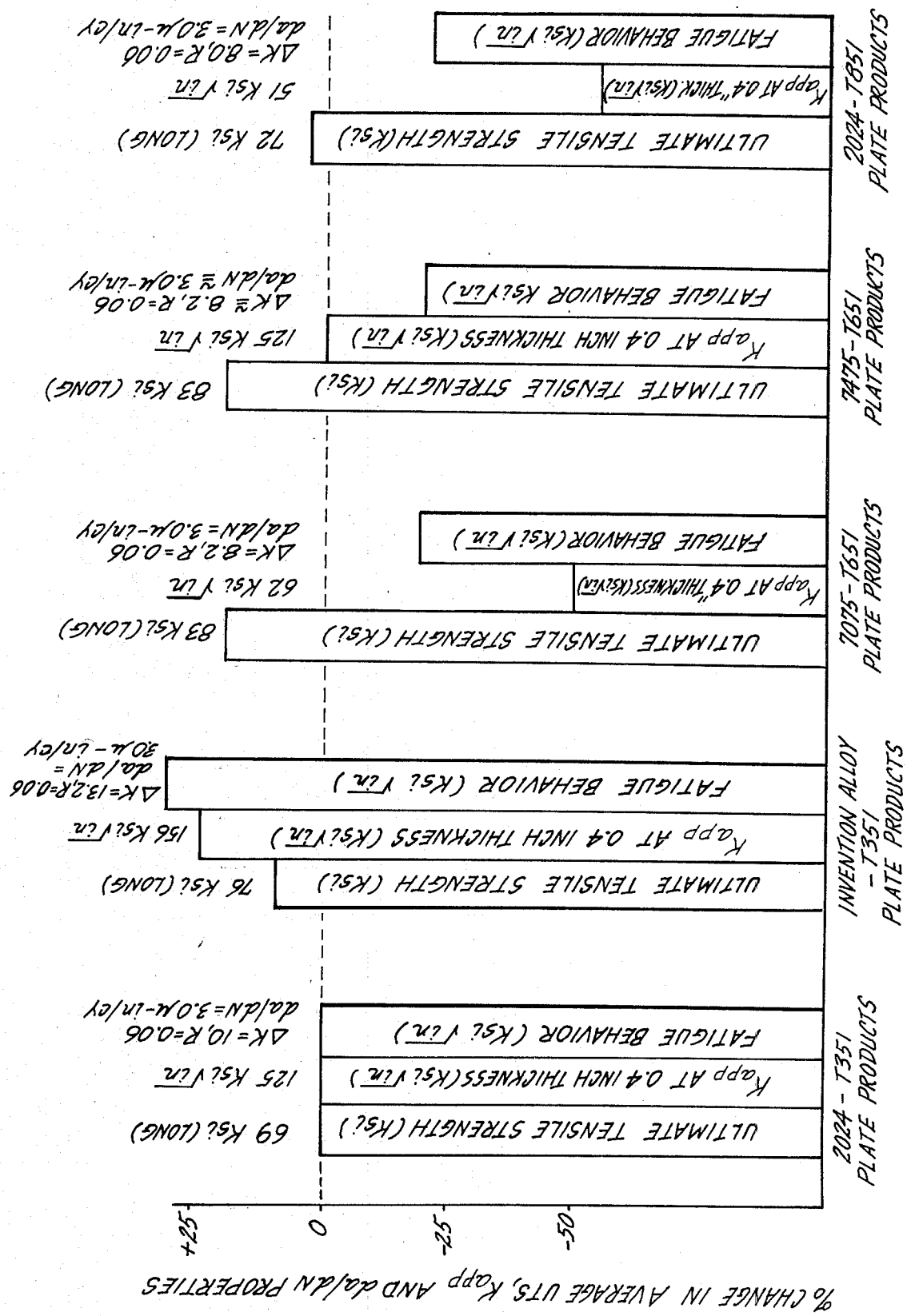
FIG. 3 is a plurality of bar graphs showing property comparisons (average values) for plate products produced from the invention alloy and other high-strength 2000 and 7000 series aluminum alloys.

The results of the ultimate tensile strength, fracture toughness, and fatigue crack growth rates are set forth in the bar graphs of FIG. 3 as percentage changes from the baseline alloy 2024-T351, which was chosen for comparison because its composition is similar to that of the invention alloy and because it is currently used for a great many aircraft applications, including lower wing surfaces. The values of the average ultimate tensile strength (UTS) and the average $K_{app}$ are set forth at the top of the appropriate bar in FIG. 3. Fatigue crack growth rate behavior is expressed as a percentage difference between the average cyclic stress intensity ($\Delta K$) required for a crack growth rate of 3.0 microinches/cycle for the various alloys and the $\Delta K$ required for a crack growth rate of 3.0 microinches/cycle in 2024-T351.

The bar graphs in FIG. 3 illustrate that the alloy of the present invention has strength, fracture toughness, and fatigue properties that are 10 to 32% better than the 2024-T351 baseline alloy. As can be seen, the 7075-T651 alloy, the 7475-T651 alloy, and the 2024-T851 alloy all have strength properties that are nearly equal to or superior to those of the invention alloy; however, the fatigue and fracture toughness properties of these alloys are not only below that of the alloy of the present invention, but are also significantly below that of the baseline alloy 2024-T351. The cyclic stress intensity ($\Delta K$) level required to provide a crack growth rate of 3.0 microinches/cycle was about 10 ksi $\sqrt{\text{in.}}$ for the 2024-T351 alloy, 13.2 ksi $\sqrt{\text{in.}}$ for the alloy of the present invention, 8.2 ksi $\sqrt{\text{in.}}$ for the 7075-T651 alloy, 8.2 ksi $\sqrt{\text{in.}}$ for the 7475-T651 alloy, and 8.0 ksi $\sqrt{\text{in.}}$ for the 2024-T851 alloy. Thus, it is observed that only by staying within the compositional limits of the alloy of the present invention, by maintaining a highly elongated and substantially unrecrystallized microstructure, and by naturally aging the alloy of the present invention to a stable condition can all three properties—strength, fracture tougness, and fatigue—be improved over those of baseline alloy 2024-T351.

Although not specifically noted in the above comparisons, the strength, fracture toughness, and fatigue comparisons for extruded products show similar relative improvements for the invention alloy over the same prior art alloys.

EXAMPLE II

The age-hardening characteristics of the invention alloy at room temperature (natural aging) are distinct from those of prior art high-strength 2000 series aluminum alloys containing copper and magnesium, such as 2024 type alloys, and lead to a continuous improvement in strength with time without loss of ductility during the natural aging.

Figure 4:
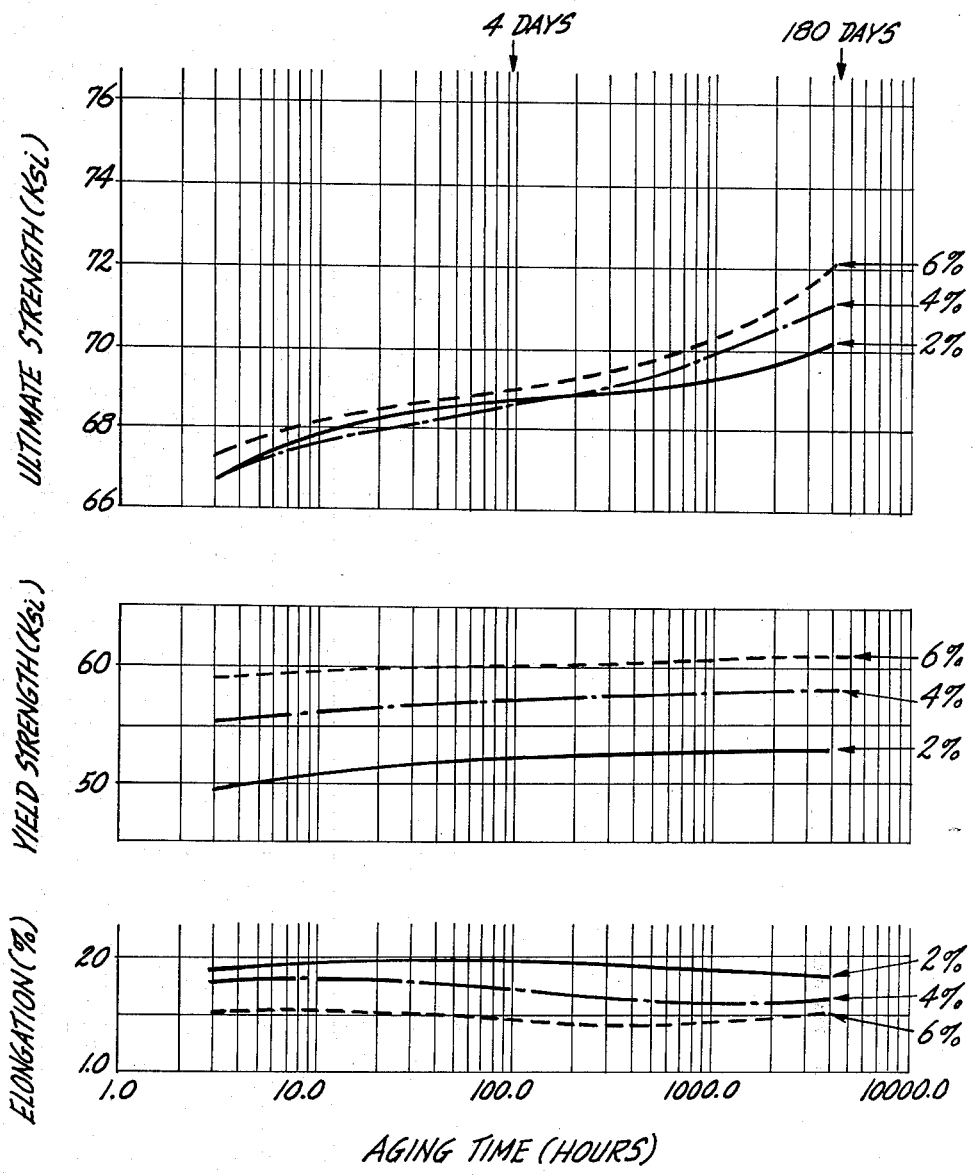
FIG. 4 is a graph showing the age-hardening characteristics of the invention alloy as a function of time and the amount of stretching following solution treatment and quenching.

Sheet material of the invention alloy was fabricated using the compositional limitations and processing procedures outlined in Example I. The sheet material was then solution treated, quenched, and then stretched a nominal 29%, 4%, and 6%, respectively. Tensile specimens were then fabricated and tested at various intervals during the first 6 months of natural aging. The tensile data are shown in FIG. 4 and show that both the ultimate tensile strength and yield strength increase continuously during the entire 6 months of aging. The elongation remained essentially constant beyond 4 days of aging. The yield strength increased more slowly than the ultimate strength; thus, the ratio of ultimate tensile strength to yield strength, which is an indicator of fracture toughness, continuously increases during the course of natural age hardening.

The natural aging of the prior art commercial alloy 2024 beyond 4 days is characterized by a stabilizing of the ultimate tensile strength, a slowly increasing yield strength, and a small reduction in elongation. Thus, both the elongation and the ratio of tensile to yield strength are decreasing with time, contrary to the invention alloy. Other prior art alloys, such as 7075 and 2014, also show a decrease in the ultimate-to-yield strength ratio during long-time natural aging.

An important feature of the extended age-hardening response of the invention alloy is that the degree of hardening depends upon the amount of stretching performed on the material subsequent to solution treatment and quench. FIG. 4 shows that as the stretch is increased from 2% to 6%, the ultimate tensile strength increases from 1.6 to 3.2 ksi (for aging between 4 and 180 days). The tensile strength increase is dependent upon, among other factors, the manganese content of the alloy. When the alloy contains less than about 0.7% manganese, an increase in tensile strength with natural aging time beyond 4 days is not observed.

EXAMPLE III

Figure 5A:
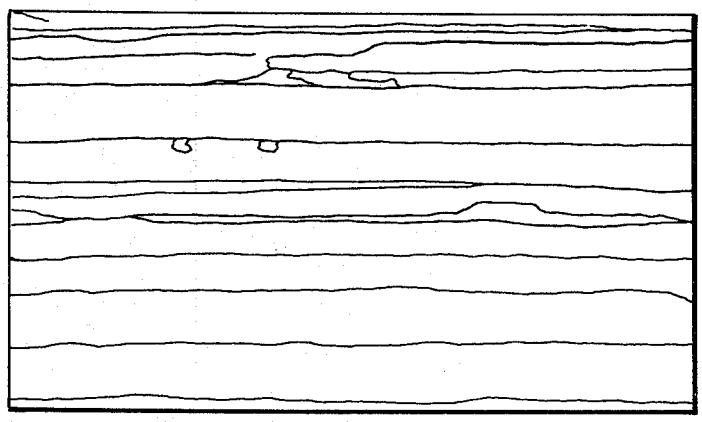
FIGS. 5*a* and 5*b* are tracings of micrographs of the microstructure of the invention alloy at 100 magnifications showing the desired unrecrystallized structure (5*a*) and the undesired recrystallized structure (5*b*)
Figure 5B:
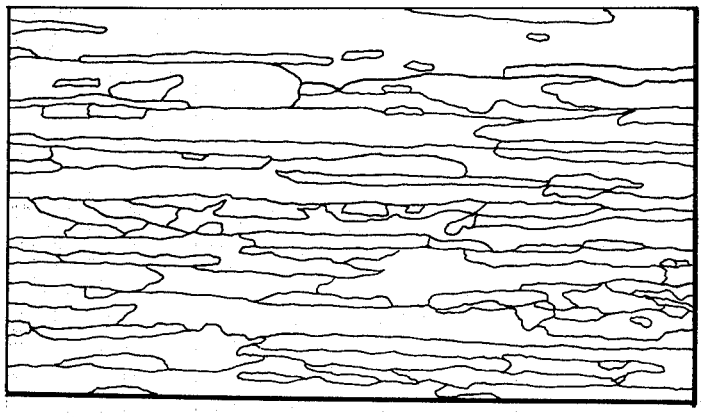

The microstructural characteristics of the alloy of the present invention are critical to the development of its high strength, fracture toughness, and fatigue properties. In particular, it has been determined that the degree of recrystallization is of prime importance in the development of both superior strength and fracture toughness performance. If recrystallization should occur, the desirable properties will not be found unless the recrystallized grain structure is highly textured and elongated in the rolling or extrusion direction. Examples of desirable (alloy FE) and undesirable (alloy JA) microstructures are shown in FIGS. 5*a* and 5*b*, respectively. These figures are tracings of 100× photo micrographs of two pieces of plate material that are approximately 1 inch in thickness and that have a similar chemical composition. Table 1-A gives the mechanical, fracture, and fatigue properties and Table 1-B the chemical composition of the subject materials.

TABLE I-A

| Alloy | Microstructure | Thickness (inches) | TUS (ksi) | TYS (ksi) | W/A $\left(\frac{\text{in.-lb}}{\text{in.}^2}\right)$ | $K_c$ (ksi $\sqrt{\text{in.}}$) | Fatigue* |
|---|---|---|---|---|---|---|---|
| FE | Unrecrystallized | 0.90 | 76.0 | 57.3 | 737 | 151 | 491,000 |
| JA | Recrystallized | 0.75 | 70.1 | 51.7 | 524 | 121 | 161,000 |

*Cycles to grow the crack approximately 0.9 inch.

TABLE 1-B

| Alloy | Chemical Composition (weight percent) | | | | | | |
|---|---|---|---|---|---|---|---|
| | Cu | Mg | Mn | Fe | Si | Ti | Zr |
| FE | 4.27 | 1.46 | 0.92 | 0.11 | 0.07 | 0.01 | 0.08 |
| JA | 4.38 | 1.54 | 0.94 | 0.11 | 0.06 | 0.01 | 0.09 |

For these materials, strength, fracture toughness tests for $K_c$, and fatigue crack growth tests with compact tension specimens of 0.10 inch thickness were taken in the manner described in Example I. The precracked charpy specimens were precracked approximately 0.050 inch deep in the direction of the width of the plate.

Figure 6C:
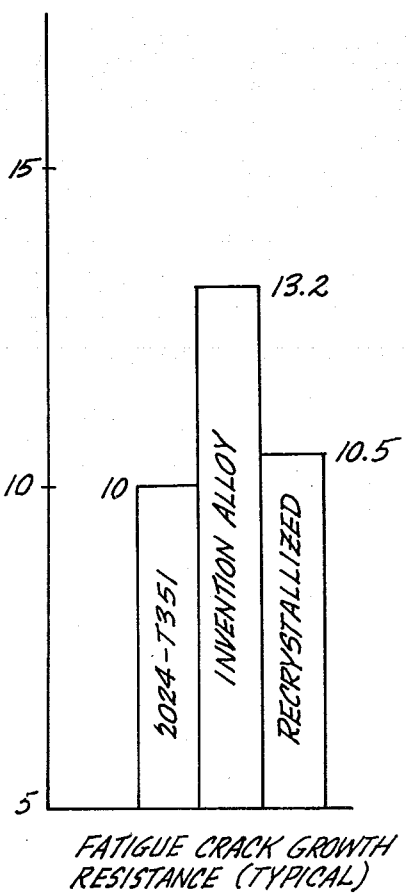
FIG. 6 is a plurality of bar graphs showing typical strength, fracture toughness, and fatigue comparisons between 2024-T351 and the invention alloy having the desired unrecrystallized structure and the undesired recrystallized structure.
Figure 6B:
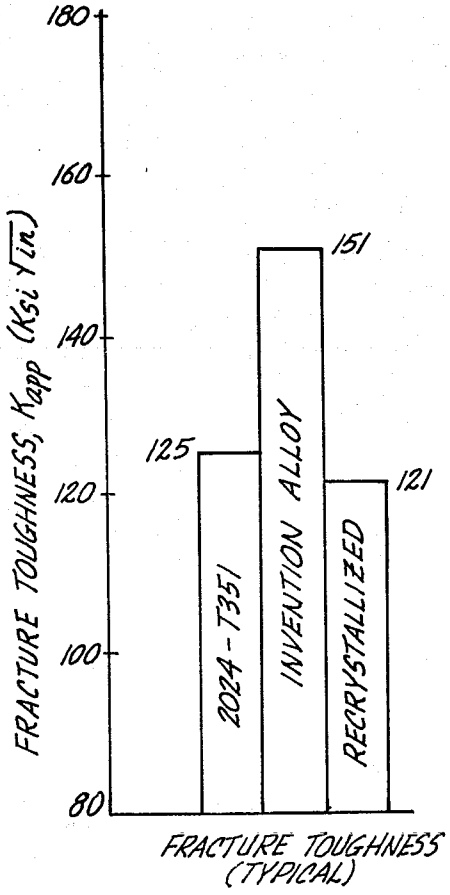
Figure 6A:
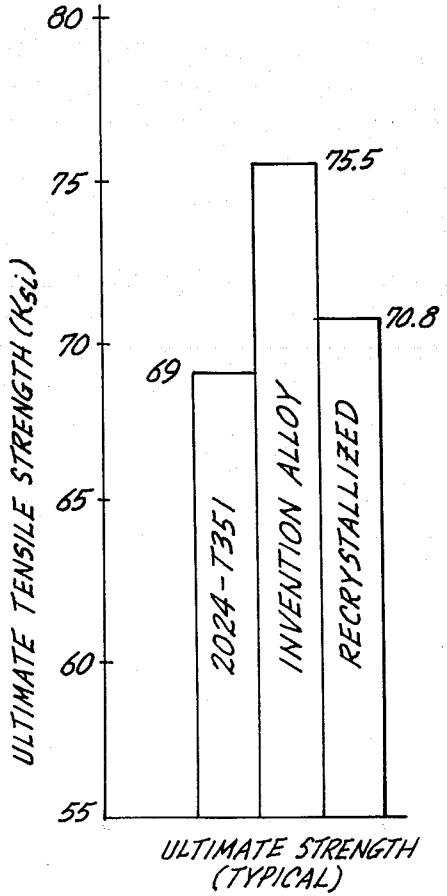

It will be noted in FIG. 5 that alloy JA is composed of a recrystallized structure having relatively small grains with a low aspect ratio (short length with respect to thickness). In contrast, alloy FE possesses an unrecrystallized structure displaying a high aspect ratio. The properties for these two materials are very different, as shown in Table 1-A. In addition, FIG. 6 provides a comparison of longitudinal tensile, fracture, and fatigue properties of the invention alloy, a recrystallized alloy of the same composition and a commercially available 2024-T351 alloy (all typical properties). It will be noted that the unrecrystallized, elongated structure of the invention alloy is substantially superior for each of the property comparisons. For example, as shown in Table 1-A for alloys JA and FE, the ultimate strength is improved by 8.4%, fracture toughness by 25%, and fatigue crack resistance by 205% (cyclic life). The strength improvement noted for longitudinally stressed, unrecrystallized material is due to a lessened influence of large intermetallic compounds and grain boundaries, to a more difficult fracture path, and, in particular, to the influence of a preferred crystallographic orientation. The improvements in fracture toughness are primarily due to the minimization of intergranular fracture in longitudinally loaded specimens, in that grain boundaries cannot be easily involved in the progress of a growing crack. Grain boundaries represent zones of weakness in precipitation-hardening aluminum alloys of this type and will bring about a general reduction of fracture toughness if they are oriented such that a growing crack can easily follow the boundaries.

The improvement in fatigue crack growth resistance is believed to be brought about by the unrecrystallized structure and the presence of zirconium. Fatigue cracks in the alloy of the present invention tend to grow in a more crystallographic manner than is observed in most aluminum alloys. When the fatigue crack front is progressing through the unrecrystallized grains, it is continuously being diverted out of its preferred growth path, which is perpendicular to the direction of principal stress. This results in a very tortuous path for growth and, consequently, very slow growth.

The property comparisons cited above in this example for recrystallized and unrecrystallized microstructures are typical of the behavior of the alloy of the present invention and illustrate that microstructural control is of critical importance to the improved properties of the invention alloy.

EXAMPLE IV

The fatigue crack growth rate (da/dN) properties of the alloy of the present invention are improved over other commercial alloys having similar characteristics, namely alloys 2024-T351, 7075-T651, and 2024-T851. Seven production lots of plate material produced from the alloy of the present invention were prepared in accordance with the general procedures set forth in Example I. In addition, eight production lots of alloy 2024-T351 plate, nine production lots of alloy 7075-T651 plate, and four production lots of alloy 2024-T851 plate were tested and analyzed using the general procedures outlines in Example I. Fatigue crack growth rate tests were conducted on precracked, single-edge-notched panels produced from the various lots of each of the above alloys. For the alloy of the present invention, 11 da/dN tests were performed; for alloy 2024-T351, eight da/dN tests were performed; or alloy 7075-T651, nine da/dN tests were performed; and for alloy 2024-T851, five da/dN tests were performed. The da/dN values for the various alloys were then averaged and plotted in FIG. 7 as the mean values of the crack growth rates (da/dN) in microinches per cycle versus the cyclic stress intensity parameter (ΔK). Curve 50 represents the crack growth rate for 2024-T851 alloy, curve 52 for 7075-T651 alloy, curve 54 for 2024-T351 alloy, and curve 56 for the alloy of the present invention. As is readily observed from the graphs of FIG. 7, the alloy of the present invention has superior fatigue crack growth rate properties at all stress intensity levels examined compared with the prior art alloys 2024-T351, 7075-T651, and 2024-T851. It is emphasized that these prior art alloys represent the state of the art for aluminum alloys now used for airframe construction.

Figure 7:
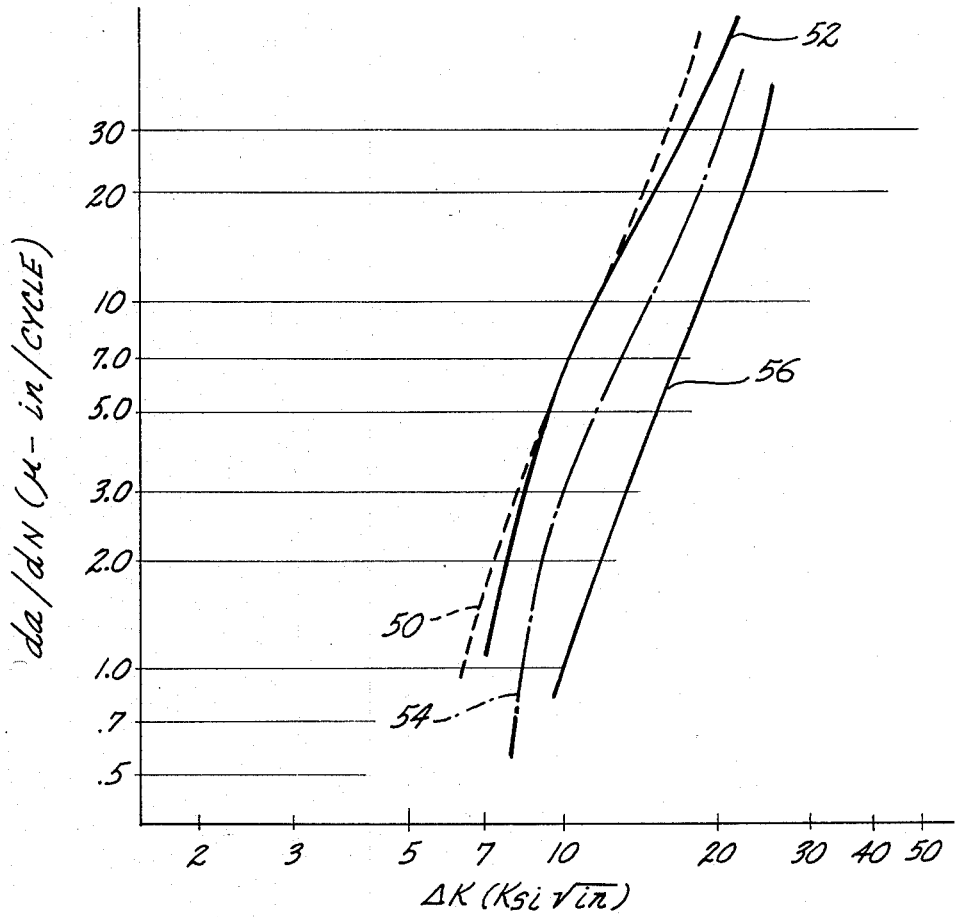
FIG. 7 is a graph of fatigue crack growth rate (da/dN) versus the stress-intensity factor ($\Delta K$) for the invention alloy and for alloys 2024-T351, 2024-T851, and 7075-T651.
Figure 8:
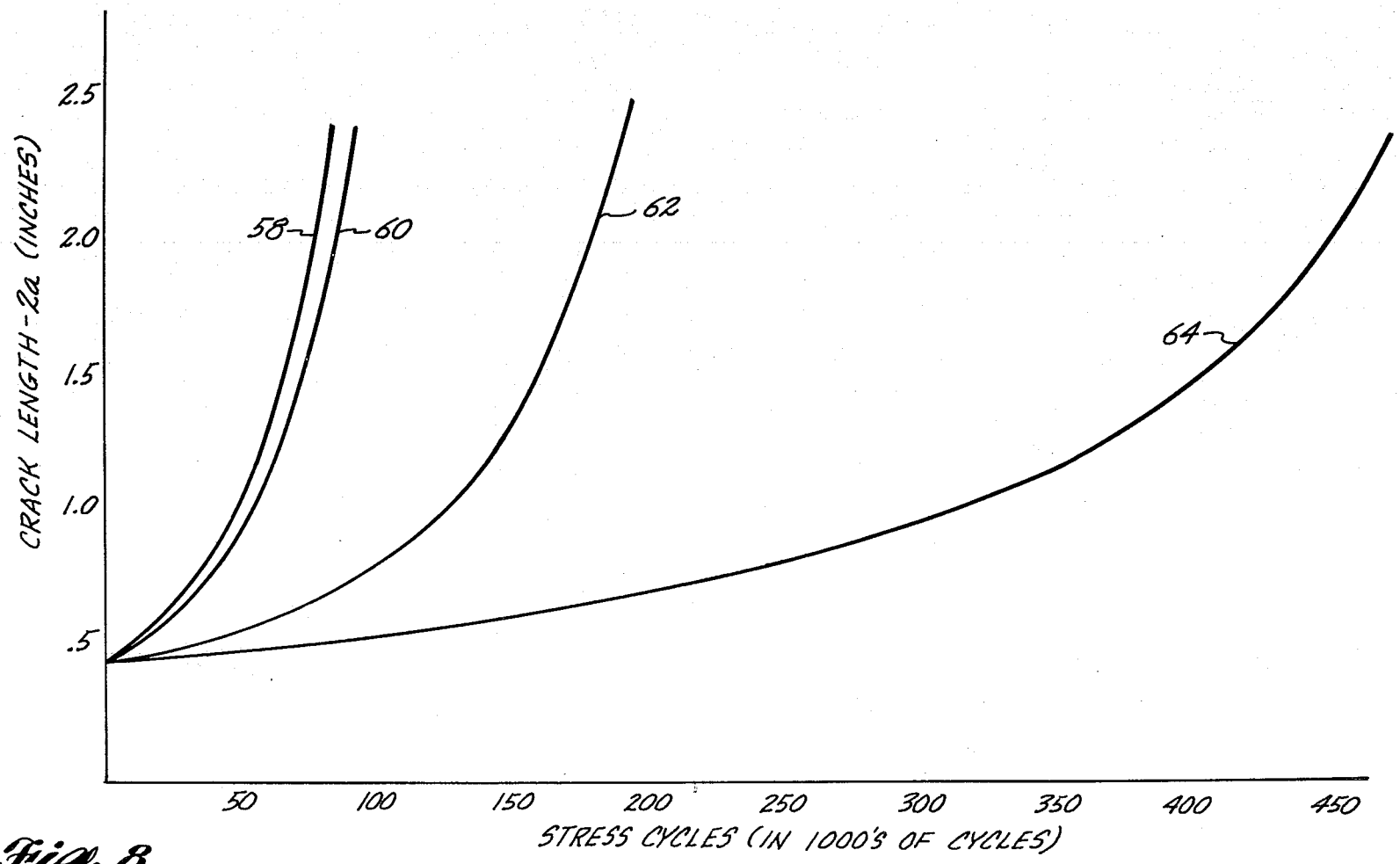
FIG. 8 is a graph of fatigue crack length versus stress cycles for the invention alloy and for alloys 2024-T351, 2024-T851, and 7075-T651.

The data from FIG. 7 were utilized to plot the graphs of FIG. 8, wherein crack length (*2a*) is plotted versus the number of stress cycles wherein the maximum stress applied was selected to be 10,000 psi, and wherein the stress ratio, R (minimum to maximum stress), was equal to 0.06. The initial crack length in the panels was selected to be 0.45 inch. Curve 58 is the graph of the data for the 2024-T851 alloy, curve 60 for the 7075-T651 alloy, curve 62 for the 2024-T351 alloy, and curve 64 for the alloy of the present invention. Again, the graphs of FIG. 8 clearly illustrate that the alloy of the present invention outperforms alloys 2024-T851, 7075-T651, and 2024-T351 in crack growth rate properties.

As can be readily observed by reference to the foregoing examples, the alloy of the present invention has a superior combination of strength, fracture toughness, and fatigue resistance when compared to the prior art alloys typified by 2024-T351, 7075-T651, and 2024-T851. Other tests conducted on the alloy of the present invention and on comparable 2024-T351 products also indicate that the stress-corrosion resistance and exfoliation-corrosion resistance are equivalent to, if not improved over, prior alloys 2024-T351 and 7075-T651. Thus, the invention alloy can be employed for the same applications as those of the prior alloys, such as wing panels and the like.

Accordingly, one of ordinary skill, after reading the foregoing specification, will be able to effect various changes, substitutions of equivalents, and other alterations to the compositions and procedures set forth above without varying from the general concepts disclosed. For example, artificial aging the alloy of the present invention to the T8 type tempers from the presently defined T3 type tempers will yield superior plate and extrusion products than are available with current alloys in T6 and T8 type tempers. It is therefore intended that a grant of Letters Patent hereon be limited only by the definition contained in the appended claims and equivalents thereof.

We claim:

1. A product produced from a 2000 series aluminum alloy having high strength, toughness, and fatigue properties, said alloy consisting essentially of

| weight percent | element |
|---|---|
| 4.2 to 4.7 | Cu |
| 1.3 to 1.8 | Mg |
| 0.8 to 1.3 | Mn |
| 0.08 to 0.15 | Zr |
| a maximum of 0.25 | Zn |
| a maximum of 0.15 | Ti |
| a maximum of 0.10 | Cr |
| a maximum of 0.15 | Fe |
| a maximum of 0.12 | Si |
| a maximum of 0.05 | each other trace element |
| a maximum of 0.15 | total of said other trace elements |

-continued

| weight percent | element |
|---|---|
| the balance being | Al, |

said alloy being homogenized to provide a substantially uniform distribution of alloying elements throughout said alloy, said alloy being hot worked to yield a wrought product having a highly elongated grain and substantially unrecrystallized microstructure after said wrought product is solution treated, quenched and aged to increase its strength.

2. The product of claim 1 wherein less than about 20 volume percent of said microstructure is recrystallized.

3. The product of claim 1 wherein said wrought product is stretcher stress relieved following solution treatment and quenching.

4. The product of claim 1 wherein said alloy is homogenized at temperatures and for times effective to ensure a dispersion of fine $Al_{20}Cu_2Mn_3$ dispersoids throughout said alloy.

5. The product of claim 1 wherein said product is naturally aged following solution treatment and quenching for a period of at least about 4 days.

6. The product of claim 5 wherein said alloy is naturally aged for a period of from about 4 to about 180 days.

7. A method of producing a product from a 2000 series aluminum alloy comprising the steps of:

forming an alloy consisting essentially of

| weight percent | element |
|---|---|
| 4.2 to 4.7 | Cu |
| 1.3 to 1.8 | Mg |
| 0.8 to 1.3 | Mn |
| 0.08 to 0.15 | Zr |
| a maximum of 0.25 | Zn |
| a maximum of 0.15 | Ti |
| a maximum of 0.10 | Cr |
| a maximum of 0.15 | Fe |
| a maximum of 0.12 | Si |
| a maximum of 0.05 | each other trace element |
| a maximum of 0.15 | total of said other trace elements |
| the balance being | Al, |

forming a body from said alloy homogenizing said body to provide a substantially uniform distribution of alloying elements, and hot working said body to form a wrought product, said hot working being conducted at temperatures effective to yield a product having a highly elongated grain and substantially unrecrystallized microstructure after solution treating and quenching said body.

8. The method of claim 7 wherein less than 20 volume percent of said microstructure is recrystallized.

9. The method of claim 7 wherein said product is stretcher stress relieved following solution treatment and quenching.

10. The method of claim 7 further comprising homogenizing the alloy in said body prior to hot working said body at temperatures and for times effective to ensure a dispersion of fine $Al_{20}Cu_2Mn_3$ dispersoids throughout said body.

11. The method of claim 7 wherein said wrought product is naturally aged following solution treatment and quencing for a period of at least about four days.

12. The method of claim 11 wherein said wrought product is naturally aged for a period of from about 4 to about 180 days.

13. The method of claim 7 wherein said said hot working comprising extruding said body into an extrusion product, said body being extruded at extrusion temperatures of at least about 750° F. and at an extrusion speed that avoids substantial hot tearing of said extrusion product.

14. The method of claim 7 wherein said hot working comprises rolling said body into a plate product, said body initially being rolled at temperatures of at least about 850° F., the temperature of said plate product being maintained above about 600° F. during subsequent rolling thereof.

15. The method of claim 14 wherein the temperature of said plate product is maintained above about 650° F. during rolling thereof.

16. The method of claim 7 wherein said hot working comprises rolling said body in a plurality of steps at an elevated temperature, and reheating said body between said steps to maintain the temperature of said product above about 650° F. during rolling thereof.

17. The method of claim 7 wherein said product is partialy annealed following hot rolling at temperatures in the range of at least 700° F. for 2 to 20 hours to minimize recrystallization during subsequent solution treatment.

18. The method of claim 17 wherein said product is annealed at temperatures ranging between 700° F. and 800° F.

19. A 2000 series aluminum alloy having high strength, toughness, and fatigue properties, consisting essentially of

| weight percent | element |
|---|---|
| 4.2 to 4.7 | Cu |
| 1.3 to 1.8 | Mg |
| 0.8 to 1.3 | Mn |
| 0.08 to 0.15 | Zr |
| a maximum of 0.25 | Zn |
| a maximum of 0.15 | Ti |
| a maximum of 0.10 | Cr |
| a maximum of 0.15 | Fe |
| a maximum of 0.12 | Si |
| a maximum of 0.05 | each other trace element |
| a maximum of 0.15 | total of said other trace elements |
| the balance being | Al, |

said alloy being homogenized to provide a substantially uniform distribution of alloying elements throughout said alloy, said alloy having a highly elongated grain microstructure after said alloy is solution treated, quenched and aged to increase its strength, said alloy having a substantially unrecrystallized microstructure.

20. The alloy of claim 19 wherein less than about 20 volume percent of said microstructure is recrystallized.

21. The alloy of claim 19 wherein said alloy is homogenized at temperatures and for times effective to insure a dispersion of fine $Al_{20}Cu_2Mn_3$ dispersoids throughout said alloy.

22. The alloy of claim 19 after having been naturally aged following solution treatment and quenching for a period of at least about four days.

* * * * *

REEXAMINATION CERTIFICATE (512th)

United States Patent [19]

Quist et al.

[11] B1 4,336,075

[45] Certificate Issued May 27, 1986

[54] ALUMINUM ALLOY PRODUCTS AND METHOD OF MAKING SAME

[75] Inventors: William E. Quist, Redmond; Michael V. Hyatt; Sven E. Axter, both of Bellevue, all of Wash.

[73] Assignee: The Boeing Company, Seattle, Wash.

Reexamination Request:
No. 90/000,516, Mar. 5, 1984

Reexamination Certificate for:

| | |
|---|---|
| Patent No.: | 4,336,075 |
| Issued: | Jun. 22, 1982 |
| Appl. No.: | 108,214 |
| Filed: | Dec. 28, 1979 |

[51] Int. Cl.[4] ..... C22F 1/04

[52] U.S. Cl. ..... 148/2; 148/11.5 A; 148/12.7 A; 148/417; 148/439

[58] Field of Search ..... 148/2, 3, 11.5 A, 12.7 A, 148/417, 439

[56] References Cited

PUBLICATIONS

Morris: Thermomechanical Processing of Aluminum Alloys, Symposium, The Metallurgical Society of AIME, St. Louis, Missouri, Oct. 8, 1979.

Van Horn: *Aluminum*, vol. III Fabrication and Finishing, American Socient for Metals, 1967, pp. 97, 98, 307, 324 and 325.

Develay: Influence Des Conditions de Travail a Chaud sur les Characteristiques de l'Alliage A-U4SG, Revue de Metallurgie.

Hyatt: New Aluminum Aircraft Alloys for the 1980's, Symposium, Associazioue Italiana Metallurgica et al., Turin, Italy, 1-2 Oct., 1976.

Staley: Microstructure and Toughness of High-Strength Aluminum Alloys, Properties Related to Fracture Toughness, ASTM STP 605, American Society for Testing and Materials, 1976, pp. 71-103.

*Primary Examiner*—R. Dean

[57] ABSTRACT

A 2000 series aluminum alloy characterized by high strength, high fatique resistance, and high fracture toughness consists essentially of 4.2 to 4.7 percent copper, 1.3 to 1.8 percent magnesium, 0.8 to 1.3 percent manganese, 0.08 to 0.15 percent zirconium, maximums of 0.15 percent iron, 0.12 percent silicon, 0.25 percent zinc, 0.15 percent titanium, 0.10 percent chromium, 0.05 percent of each of any other trace elements present, and a maximum total of such other trace elements of 0.15 percent, the balance of the alloy being aluminum. The foregoing alloy is hot-worked and heat-treated to yield a final wrought product having a highly elongated and substantially unrecrystallized microstructure.

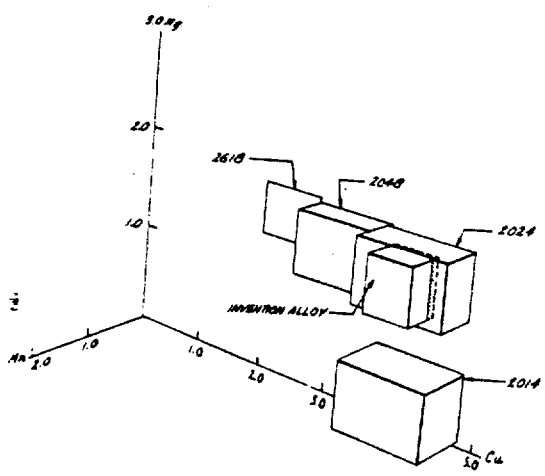

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-22 is confirmed.

* * * * *